US005863139A

United States Patent [19]

Asai et al.

[11] Patent Number: 5,863,139

[45] Date of Patent: Jan. 26, 1999

[54] PRINTING APPARATUS AND A CONTROL METHOD THEREFOR

[76] Inventors: Naoki Asai; Hideki Kawakami; Choji Morozumi, all of 3-5 Owa 3-chome, Suwa-shi, Naguno-ken 392, c/o Seiko Epson Corporation, Japan

[21] Appl. No.: 898,902

[22] Filed: Jul. 22, 1997

Related U.S. Application Data

[63] Continuation of Ser. No. 415,966, Apr. 3, 1995, Pat. No. 5,664,895.

[30] Foreign Application Priority Data

Apr. 4, 1994 [JP] Japan ..... 6-66203
Oct. 25, 1994 [JP] Japan ..... 6-260644

[51] Int. Cl.[6] ..... B41J 33/56

[52] U.S. Cl. ..... 400/248.1; 400/248.2; 400/642

[58] Field of Search ..... 400/248, 248.1, 400/596, 642, 248.2, 247

[56] References Cited

U.S. PATENT DOCUMENTS

| | | | |
|---|---|---|---|
| 4,496,256 | 1/1985 | McMorrow et al. . | |
| 4,844,361 | 7/1989 | Feron et al. | 400/596 |
| 4,846,595 | 7/1989 | Kato et al. . | |
| 4,897,589 | 1/1990 | Fujiwara et al. | 400/322 |
| 4,929,102 | 5/1990 | Mizutani et al. . | |
| 5,090,825 | 2/1992 | Merriman, Jr. et al. | 400/58 |
| 5,286,123 | 2/1994 | Kusumi | 400/248 |
| 5,613,785 | 3/1997 | YUasuoka | 400/248.1 |

FOREIGN PATENT DOCUMENTS

| | | | |
|---|---|---|---|
| 0 073 114 | 3/1983 | European Pat. Off. . | |
| 0222373 | 12/1984 | Japan | 400/600.1 |
| 1-171879 | 6/1989 | Japan . | |
| 4-53786 | 2/1992 | Japan . | |
| 2 209 501 | 5/1989 | United Kingdom . | |

OTHER PUBLICATIONS

IBM Technical Disclosure Bulletin; vol. 16, No. 3, Aug. 1973, New York USA, pp. 834–835; XP002015719; G. C. Matuck and W. D. Thorne, "Detentable Ribbon Shield".

*Primary Examiner*—John S. Hilten
*Attorney, Agent, or Firm*—Eric B. Janofsky

[57] ABSTRACT

A printing apparatus comprises a platen, a dot impact print head (23) opposite to the platen, a mask plate (40) between the platen and the print head with a paper passage between the platen and the mask plate (40), and an ink ribbon (31) between the print head and the mask plate. Transport mechanisms are provided to move the mask plate (40) in a direction substantially perpendicular to said paper passage between a first position on the print head side and a second position on the platen side, the transport mechanisms being responsive to the position of the print head along the platen. In the first position of the mask plate a relatively wide gap between the platen and the mask plate enables easy paper insertion, while in the second position a relatively wide gap between the mask plate and the print head facilitates replacement of the ink ribbon without problems.

4 Claims, 11 Drawing Sheets

(b)

PRINTING APPARATUS AND A CONTROL METHOD THEREFOR

This is a Continuation of prior application Ser. No. 08/415,966 filed on Apr. 03, 1995 now U.S. Pat. No. 5,664,895 the contents of which are incorporated herein by reference.

BACKGROUND OF THE INVENTION

1. Field of the Invention

This invention relates generally to a printing apparatus (simply referred to as printer in the following) for printing cut-sheet type print media, including cards and slips.

"Cards," as the term is used in this text, refers to various kinds of card type paper like that used for checks, validations, etc. Cards are relatively stiff and, therefore, should not be bent on their way into or through the printer. "Slips" on the other hand refers to various types of relatively soft cut-sheet paper which may be transported through a bent paper path. Both cards and slips may either comprise a single sheet or multiple sheets (hereinafter referred to as ply paper, ply cards or ply slips).

2. Description of the Related Art

Printers with many different functions have been developed in recent years and are capable of printing to various types of paper. Printers that can be used for journal printing using roll paper, card printing using cards or slip printing using slips have also been introduced.

Printers capable of printing to ply paper are primarily dot matrix-type impact printers. With this type of printer, the paper is fed through the platen gap, which is the gap between the printer platen and a dot impact print head, and printing is accomplished by means of the print head opposite the paper and an ink ribbon between the print head and the paper.

Printers capable of printing to ply paper are primarily dot matrix-type impact printers. With this type of printer, the paper is fed through the platen gap, which is the gap between the printer platen and a dot impact print head, and printing is accomplished by means of the print head opposite the paper and an ink ribbon between the print head and the paper.

OBJECTS OF THE INVENTION

In order to increase the printing speed with this type of printer, the platen gap is decreased and the response of the print head is increased. In order to suppress printing noise resulting from the printing on paper lifted from the platen and resonating, a mask plate is inserted between the ink ribbon and the paper to hold the paper against the platen. This mask plate also functions to prevent interference between the paper and ink ribbon during printing. The mask plate is particularly important when ply cards are inserted into the platen gap in order to prevent soiling of the ply cards by unintended contact with the ink ribbon, and printing defects caused if the ink ribbon is pushed down out of alignment with the print head.

However, when the platen gap is reduced, the paper, mask plate, and ink ribbon must coexist within an extremely narrow gap. As a result, cards can be easily and mistakenly inserted between the mask plate and print head rather than between the mask plate and platen. In addition, removing the ink ribbon can be difficult, and the ink ribbon can be mistakenly inserted between the mask plate and platen instead of between the mask plate and print head when an ink ribbon cartridge is replaced.

Therefore, the object of the present invention is to provide a printing apparatus which is quiet, enables simple and reliable loading and positioning of various types of cut-sheet paper, and is free of soiled paper and printing errors.

A further object is to provide a printing apparatus whereby excessive costs due to problems with paper feeding, and wasted work time, can be eliminated.

A further object is to provide a printing apparatus whereby the user can easily replace the ink ribbon, and soiled paper and printing errors thereby do not occur.

Another object of the invention is to provide a control method suitable to such a printing apparatus.

These objects are achieved with a printing apparatus and a control method, respectively, as claimed.

SUMMARY OF THE INVENTION

The present invention allows to meet the contradicting requirements of a narrow platen gap for an increased printing speed and low noise and of a wide platen gap for easy insertion of paper and replacement of ink ribbon. To that end a mask plate is provided in a narrow platen gap such as to be movable between a position nearer to the print head and a position nearer to the platen means. In the former position of the mask plate a relatively wide gap between the platen means and the mask plate enables easy paper insertion, while in the latter position a relatively wide gap between the mask plate and the print head facilitates replacement of the ink ribbon without problems.

In a preferred embodiment of the invention the platen means comprises a fixed paper guide and a platen movable between a standby mode and a printing mode. In the standby mode an effective platen gap is defined between the paper guide and the print head while the platen itself is retracted to the side of the paper guide remote from the print head. In the printing mode the platen projects from the paper guide towards the print head and the effective platen gap is reduced to the platen gap which is defined between the platen and the print head. Thus, in addition to changing the position of the mask plate, the effective platen gap may be changed between standby and printing modes, i.e. a relatively wide effective platen gap in the standby mode and an extremely narrow platen gap in the printing mode.

The position of the mask plate is changed in response to the position of the print head. Moving the print head to one or more first predetermined positions brings the mask plate into one position while moving the print head to one or more second predetermined positions brings the mask plate into the other position. Thus, the drive source for moving the print head can be utilized as drive source for moving the mask plate between those positions. A cam and cam follower arrangement between the mask plate and a mask guide, with one part fixed stationary and the other part movable together with the print head, is one possibility of achieving such movement of the mask plate by movement of the print head.

As will be appreciated, while the description refers to paper it goes without saying that other types of print medium may be used as well.

BRIEF DESCRIPTION OF THE DRAWINGS

Embodiments of the invention will be described in detail below with reference to the schematic drawings throughout which the same reference signs denote same or similar parts and in which:

FIG. 9(A) shows the mask plate pressing against the platen (paper guide); and FIG. 9(B) shows the mask plate raised from the platen to the print head.

DESCRIPTION OF THE PREFERRED EMBODIMENTS

While the invention has been described in conjunction with several specific embodiments, it is evident to those skilled in the art that many further alternatives, modifications and variations will be apparent in light of the foregoing description. Thus, the invention described herein is intended to embrace all such alternatives, modifications, applications and variations as may fall within the spirit and scope of the appended claims.

Preferred embodiments are subject-matter of the dependent claims.

A first embodiment of a printing apparatus according to the present invention is described below with reference to FIGS. 1 to 7.

Figure 1:
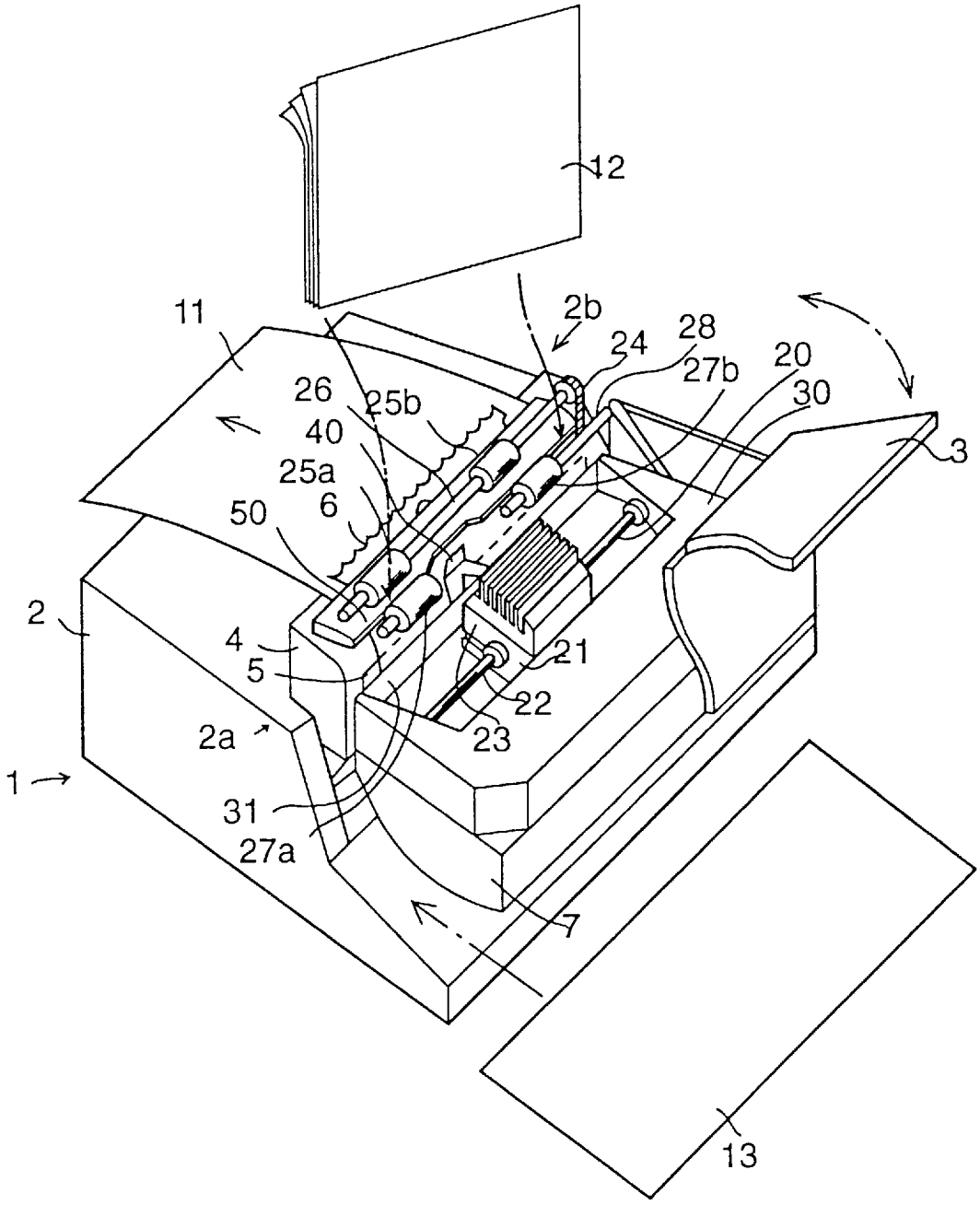
FIG. 1 is a bird's-eye view of a printer according to a first embodiment of the present invention.

Referring to FIG. 1, printer 1 stores roll paper 11 in one end of a body 2, which extends slightly in the direction in which roll paper 11 is transported. A head unit 21 moving in the direction crosswise to roll paper 11 along carriage guide shaft 20 is disposed to the end of body 2 opposite that in which roll paper 11 is stored.

As will be explained in detail later, in addition to roll paper 11 the printer of this embodiment allows printing on cut-sheet paper. There are two different ways for insertion of cut-sheet paper: cards 12 are preferably inserted at the top of the printer and slips 13 are preferably inserted at the bottom of the printer. Paper inserted from the top can also be ejected from the top and is then guided along a straight paper path within the printer without being bent. On the other hand, paper inserted from the bottom has to pass a bent or curved paper path before reaching a position for being printed.

Head unit 21 is supported by guide shafts 20 and 20*a*, and is mounted on carriage unit 22, which is movable to each position within a printing area along guide shaft 20 by means of a timing belt not shown in the figures. Print head 23 for dot matrix printing projects from head unit 21 at a position facing roll paper 11. Ribbon case 30 is installed behind head unit 21, i.e., on the side of head unit 21 opposite roll paper 11. An exposed portion of ink ribbon 31 from ribbon case 30 extends in proximity to roll paper 11, and crosses roll paper 11 in the direction of guide shaft 20. The ink ribbon 31 passes between print head 23 and roll paper 11. Ink ribbon 31 is gradually wound by a mechanism internal to the printer in response to the movement of print head 23 such that unused parts of ink ribbon 31 are struck by the wire dots of print head 23 to print to the roll paper or cut-sheet paper that may be used with this printing apparatus as will be explained below.

A mask plate 40 extends between ink ribbon 31 and roll paper 11. In this embodiment the mask plate is fixed to carriage unit 22 below print head 23 (see FIG. 2) and extends upward past print head 23.

The printer 1 of this embodiment further comprises a paper guide 4 long in the crosswise direction of body 2 and facing head unit 21 with roll paper 11 held therebetween. The paper guide 4 has a U-shaped vertical cross section at the approximate center of which is formed an opening 4*a* for insertion and removal of platen 5. If the paper is set to the surface side of paper guide 4 facing print head 23, the back of the paper can be reliably supported because platen 5 projects from the back of the paper during printing.

A mask guide 50 engaging contacting member 45, which forms the upper end of mask plate 40, and a cutter 6 for cutting the roll paper, are provided above this paper guide 4, i.e., in the direction in which roll paper 11 is transported in the printer 1 according to this embodiment. It is to be noted that mask guide 50 and cutter 6 extend in the lateral direction of body 2 over a length substantially corresponding to the printing area. Roller shaft 26 is disposed in parallel to and above mask guide 50. Roller shaft 26 is supported by a lever 10 described later. Transport rollers 25 (25*a* and 25*b*) are fixed to the two end portions of roller shaft 26. The roller shaft 26 is connected to a paper transport feed motor (not shown in the figures) by means of belt 24 disposed at the right side 2*b* of body 2 as shown in FIG. 1.

Figure 2:
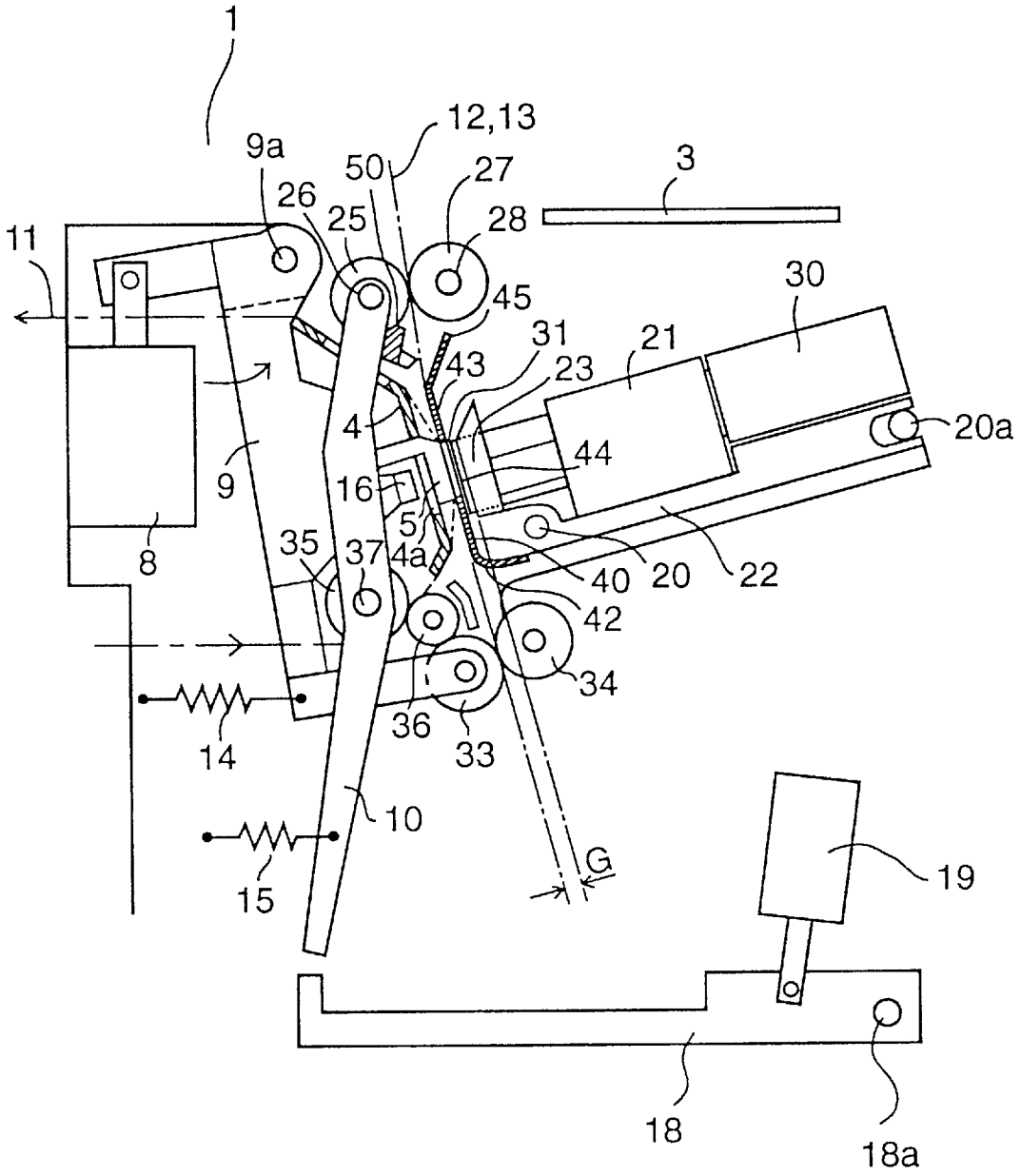
FIG. 2 is an enlarged cross section of the assemblies around the print head of the printer shown in FIG. 1 set to the printing mode.

Printer 1 of this embodiment further comprises a cover 3 covering head unit 21 and ribbon case 30, and pivotally hinged to body 2 so that cover 3 may be moved between an opened position (shown in FIG. 1) and a closed position (indicated in FIG. 2). Shaft 28 is disposed above head unit 21, and carries rollers 27 (27*a* and 27*b*) at positions corresponding to rollers 25*a* and 25*b*, respectively. In case of card printing, the card 12 is held between these rollers 27 and the opposing rollers 25, and is transported thereby.

A curved bottom paper guide 7 is disposed below head unit 21 for inserting slips 13, which are typically long in the horizontal direction, through the gap between bottom paper guide 7 and body 2.

Printer 1 according to the present embodiment can therefore load and print to three different types of paper: roll paper 11, cards 12, and slips 13.

FIG. 2 is an enlarged cross section of the assemblies around print head 23 and paper guide 4 of a printer 1 according to the present embodiment of the invention. Printer 1 of this embodiment can operate in either of two modes: a mode for printing, and a standby mode for loading and removing the paper, and for replacing the ink ribbon. As will be explained later, plunger 8 is used for switching between these two modes. Note that the mechanisms shown in FIG. 2 are shown in the positions assumed during the printing mode.

By energizing plunger 8, arm 9 is rotated about pivot point 9*a* in a counterclockwise direction (as seen in FIG. 2) from the standby condition (FIG. 3) to the printing condition. This brings the printer into the printing mode. As a result, bottom transport roller 33 provided at the bottom of arm 9 contacts opposing auxiliary roller 34, thus to form the bottom paper transport mechanism.

The paper transport mechanism for roll paper 11 is formed by roller 36 and auxiliary roller 35.

Figure 3:
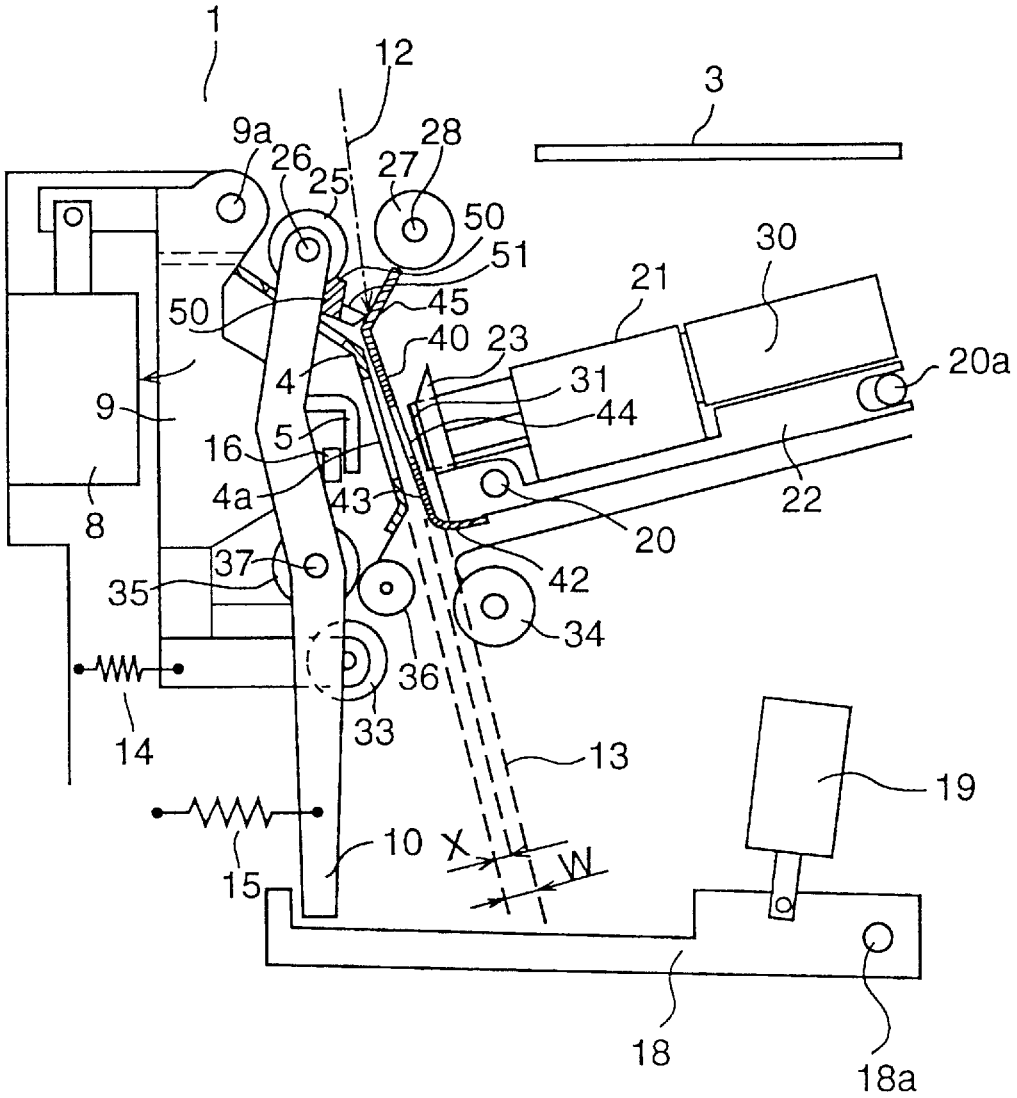
FIG. 3 is an enlarged cross section of the assemblies around the print head of the printer shown in FIG. 1 set to the standby mode for paper insertion.

As shown in FIG. 3, the lever 10 extends in the vertical direction and supports shaft 26 at its upper end portion. The lever 10 itself is pivotally supported for a swing movement around fulcrum 37. In the clockwise direction this swing movement is limited by stopper 16 mounted on arm 9, when platen 5 is in its standby condition so that the transport rollers 25 are not in contact with the auxiliary rollers 27 and the paper can not be conveyed. In addition, the lower end of lever 10 is releasably engaged with a lever 18 so that the swing movement in the clockwise direction can also limited by lever 18 depending on the position of lever 18. The purpose of lever 18 will be explained later. Therefore, when arm 9 is moved in the counterclockwise direction by plunger 8 and lever 18 is moved in the counterclockwise direction by plunger 19, lever 10 is released from both and rotated in the clockwise direction by spring 15 so that transport rollers 25 are brought into contact with auxiliary rollers 27, thus forming the top paper transport mechanism.

In the printing condition of arm 9, platen 5 which extends in the direction of print head 23 from arm 9, projects from opening 4*a* of paper guide 4 in the direction of print head 23, and thereby pushes the back of the paper in the direction of print head 23.

Thus, the paper transport mechanisms can be made effective by means of plungers 8 and 19 in the printing mode with printer 1 according to this embodiment, and the back side of the paper can be firmly supported by platen 5. Roll paper 11 for journal printing can be fed by the paper transport mechanism formed by rollers 35 and 36. Cards 12 inserted from the top of printer 1, and slips 13 inserted from the bottom, can also be fed to their respective printing positions by means of the top paper transport mechanism comprising rollers 25 and 27, and the bottom paper transport mechanism comprising rollers 33 and 34, respectively.

As shown in FIG. 3, in the standby mode of the printer with the platen 5 retracted behind paper guide 4 an effective platen gap W is established between the print head 23 and the paper guide 4. When plunger 8 is operated, platen 5 projects forward from paper guide 4, thereby narrowing the effective platen gap to the platen gap G, which is the gap between platen 5 and print head 23. The paper, mask plate 40, and ink ribbon 31 are disposed in this order in the platen gap G from the platen 5 side of the gap.

Mask plate 40 is made from a thin metal plate, the bottom 42 of which curves gently and is fastened to carriage unit 22. An intermediate portion of mask plate serves as a pressing member as will be explained later. A roughly diamond-shaped opening 44 long in the vertical direction is formed in the pressing member. Print head 23 strikes ink ribbon 31 through opening 44 against the paper to print. The top of mask plate forms a contacting member 45 extending further upward from pressing member 43. As best seen in FIGS. 2 and 3, contacting member 45 is inclined from paper guide 4 in the direction of print head 23 thus forming an insertion guide opening at the top of printer 1 facilitating insertion of a card 12. Mask plate is flexible and by its own resiliency it is biased towards paper guide 4 such that in the printing mode the pressing member 43 of mask plate 40 presses against platen 5. As a result, the paper can be pressed against platen 5 by means of mask plate 40.

By thus disposing mask plate 40 between ink ribbon 31 and the paper, interference between the paper and ink ribbon 31 can be prevented. As a result, paper smudging resulting from contact between the paper and ink ribbon 31, and problems such as printing defects caused by ink ribbon 31 being offset from the predetermined position by the paper transport operation, can be prevented when loading paper and when the paper is being transported. High speed, high quality printing is therefore made possible.

In addition, because the paper can be pressed against platen 5 using mask plate 40 as described, the paper can be prevented from lifting off the platen during printing, and the noise associated with such lifting off can be suppressed. When printing to ply paper such as ply cards 12, the multiple sheets can be held firmly together against the platen, thereby reducing noise and improving the quality of printing to the overlaid paper.

Furthermore, in a printer capable of printing on cards 12 as well as roll paper 11 as described in the first embodiment above, it is also possible to dependably hold the paper to the platen irrespective of the thickness of the paper by using the elastic mask plate 40. It is therefore possible to achieve high quality printing to paper of variable thicknesses and types.

FIG. 3 is an enlarged cross section of the assemblies around print head 23 and paper guide 4 of a printer 1 according to the present embodiment of the invention in the standby mode allowing cards 12 or slips 13 to be loaded into the paper passage defined between paper guide 4 and mask plate 40.

In this standby mode, arm 9 is rotated about pivot point 9*a* in the direction separating it from paper guide 4 by operating plunger 8. Note that arm 9 may be driven in the direction separating it from paper guide 4 by means of plunger 8, or arm 9 may be rotated by the force of spring 14 with plunger 8 in an unexcited state as in the present embodiment.

When arm 9 rotates to separate from paper guide 4, transport roller 33 separates from auxiliary roller 34. When released from lever 18, lever 10 is also rotated in the direction away from print head 23 by means of stopper 16 on arm 9, thus causing transport rollers 25 to separate from auxiliary rollers 27. If arm 9 is rotated by spring 14 in this case, the force of spring 14 rotating arm 9 must be greater than the force of spring 15 rotating lever 10.

When arm 9 rotates in the direction separating it from paper guide 4, platen 5 connected to arm 9 is pulled away from opening 4*a* in paper guide 4. The gap between print head 23 and platen 5 thus increases, and the effective platen gap W between print head 23 and paper guide 4 can be assured on the paper side of print head 23. By pulling platen 5 to the inside of paper guide 4, the flexible mask plate 40 pressed against platen 5 also rotates toward paper guide 4, the inclination angle changes, and guide member 51 of mask guide 50 disposed above paper guide 4 contacts contacting member 45 of the mask plate. As a result, pressing member 43 of mask plate 40 is kept apart from the surface of paper guide 4, and a gap X is maintained between mask plate 40 and paper guide 4.

Figure 4:
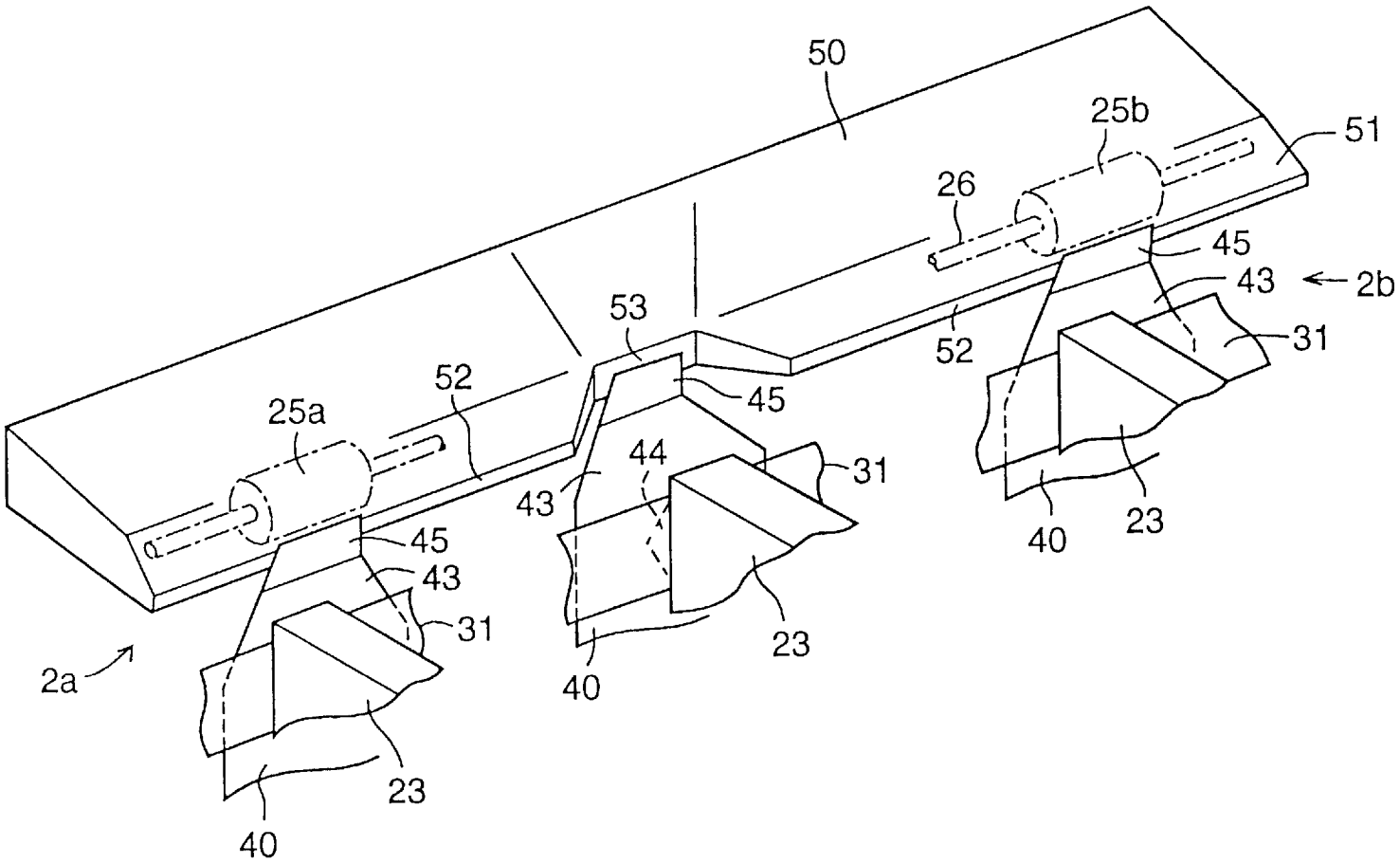
FIG. 4 is an enlarged view of the mask guide of the printer shown in FIG. 1.

FIG. 4 shows mask guide 50 and mask plate 40, which moves along guide member 51 of mask guide 50 as the head unit 21 is moved. Mask guide 50 is a plate-shaped member extending in the direction from one side 2*a* to the other side 2*b* of printer 1, and the edge of mask guide 50 on the print head 23 side forms guide member 51 guiding contacting member 45 of mask plate 40. Guide member 51 comprises parts 52 projecting towards print head 23 at both sides, and a part 53 recessed away from print head 23 in the middle of guide member 51 between parts 52. Note, further, that mask guide 50 is provided in printer 1 with parts 52 thereof sloped at a downward incline toward print head 23.

FIG. 3 shows the state wherein print head 23 has moved toward either side of printer 1, and is positioned below transport roller 25*a* or 25*b*. For example, if print head 23 is assumed to be positioned below transport roller 25*b*, the printer is in the standby mode due to the action of plunger 8, and transport roller 25*b* above mask plate 40 is separated from auxiliary roller 27*b*. When mask plate 40 is below auxiliary roller 27*b*, contacting member 45 contacts the projecting part 52 of mask guide 50 and is separated from paper guide 4, and the upper part of the mask plate 40 is positioned below auxiliary roller 27*b*. Because mask plate 40 is therefore sheltered by auxiliary roller 27*b* from the inserted paper, the paper cannot be accidentally inserted between mask plate 40 and print head 23.

In addition, contacting member 45 and the projecting parts 52 of the guide member are in contact with each other such that they are aligned with an opening to the top, enabling a card 12 to be easily inserted therebetween. Mask plate 40 is pressed against the guide member only by its own elastic force so that a card having a comparatively large thickness and high rigidity can be smoothly inserted therebetween by opening the contacting portion. As a result, a paper path for card 12 is formed between rollers 25*b* and 27*b*, and between the contacting portions of the contacting member 45 and the projecting part 52 of mask guide 50.

When the user inserts a card 12 between rollers 25*b* and 27*b*, the card 12 passes between rollers 25*b* and 27*b* and is automatically guided to the contacting parts of the contacting member 45 of the mask plate and the projecting part 52 of mask guide 50. Card 12 thus passes through this contact area and is transported to the predetermined position between mask plate 40 and paper guide 4. In case of ply cards (2-ply, 3-ply or more) the edges of the two or more sheets are not necessarily aligned. However, by passing such card between these rollers 25*b* and 27*b*, all of the multiple sheets can be smoothly inserted between paper guide 4 and mask plate 40. In addition, because there is a relatively wide gap X between paper guide 4 and mask plate 40, there is no hindering interference between card 12 and mask plate 40 or paper guide 4 when a card 12 is being loaded. Because mask plate 40 is stopped by mask guide 50, card 12 is not unnecessarily pressed against paper guide 4. As a result, card 12 can be inserted without jamming or damage to card 12.

Furthermore, because contacting member 45 of mask plate 40 slopes out towards print head 23 and forms a guide member, contacting member 45 prevents such problems as mistakenly inserting a ply card 12 with one or more of its sheets entering between mask plate 40 and ink ribbon 31. Smudging of card 12 from interference between the ink ribbon and card 12 when inserting card 12 also does not occur because mask plate 40 is between ink ribbon 31 and card 12. Inserting card 12 also does not dislocate ink ribbon 31. As a result, the user can easily load a card 12 to a printer according to the present embodiment.

Once a card 12 has been loaded and the printing mode as shown in FIG. 2 is resumed, mask plate 40 and card 12 are raised by platen 5. As a result, contacting member 45 of mask plate 40 separates from mask guide 50, card 12 can be set firmly to platen 5 using mask plate 40, and high quality printing can be achieved.

Typically, cards 12 are relatively narrow in width and have a confined printing area. In such case one end of the card is set to be guided by one end of the paper insertion inlet. In this embodiment, an operator inserts the card being guided along the right side of the inlet or inserts it up to the right side edge of the paper path in the vicinity of which the transport roller 25*b* is provided. In addition, for insertion of a card, print head 23 is moved below transport roller 25*b* so that contacting member 45 of mask plate 40 is held in a position away from paper guide 4 by part 52 protruding from mask guide 50.

On the other hand, slip paper 13 which is inserted from a lower part of printer 1, below the head unit 21, may be wider and have a larger printing area. In the present embodiment, the printer body has a wall on the right hand side of the paper path while it is open at the left hand side. The wall at the right hand side can be used as a guide for slip insertion while the open left hand side allows use of various types of slips having different widths. As a result, frictional forces acting on a slip being inserted are different on each side. To compensate for this difference it is preferable to move the print head 23 and, thus, the mask plate 40 to the left side prior to slip insertion, thereby to prevent a skew of the slip while it is being inserted.

When loading a slip 13, the top of the slip 13 is transported to a position of the lower part of contacting member 45 by means of a paper transport mechanism provided on auxiliary guide 7. At that time, the distance which slip 13 is to be transported can be easily determined, because a paper sensor (131 in FIG. 7, not shown in FIG. 1) is provided in the paper path in the lower part of the printer body and in general, a paper stopper is also provided in the path, such that an operator can easily set the slip to a predetermined position.

Next, when platen 5 is projected from paper guide 4 toward the print head, mask plate 40 presses slip 13 against platen 5. At that time, lever 18 is still engaged with lever 10, so that transport rollers 25 are maintained in the condition of not being in contact with auxiliary rollers 27. Since the top of slip 13 has already passed platen 5, mask plate 40 presses the slip in the portion below the top. In this condition, slip 13 is further transported and when the top reaches a position between rollers 25 and 27, plunger 19 is activated so that the engagement between lever 10 and lever 18 is released, thereby bringing rollers 25 into contact with rollers 27. By utilizing corresponding control steps of the paper transportation, it is possible to make a gap between mask plate 40 and mask guide 50 while the top of slip 13 is passing between them toward transport rollers 25 so that a paper jamming in the vicinity of mask plate 40 can be prevented even when the thickness of the slip is small or the slip is a ply slip. Also, because the transportation of slip 13 is restarted after the slip is nipped by the rollers 25, 27, problems such as the slip becoming sagged by being stopped at the periphery of one of the rollers 25, 27 can be avoided, thereby achieving an accurate transportation.

Figure 5:
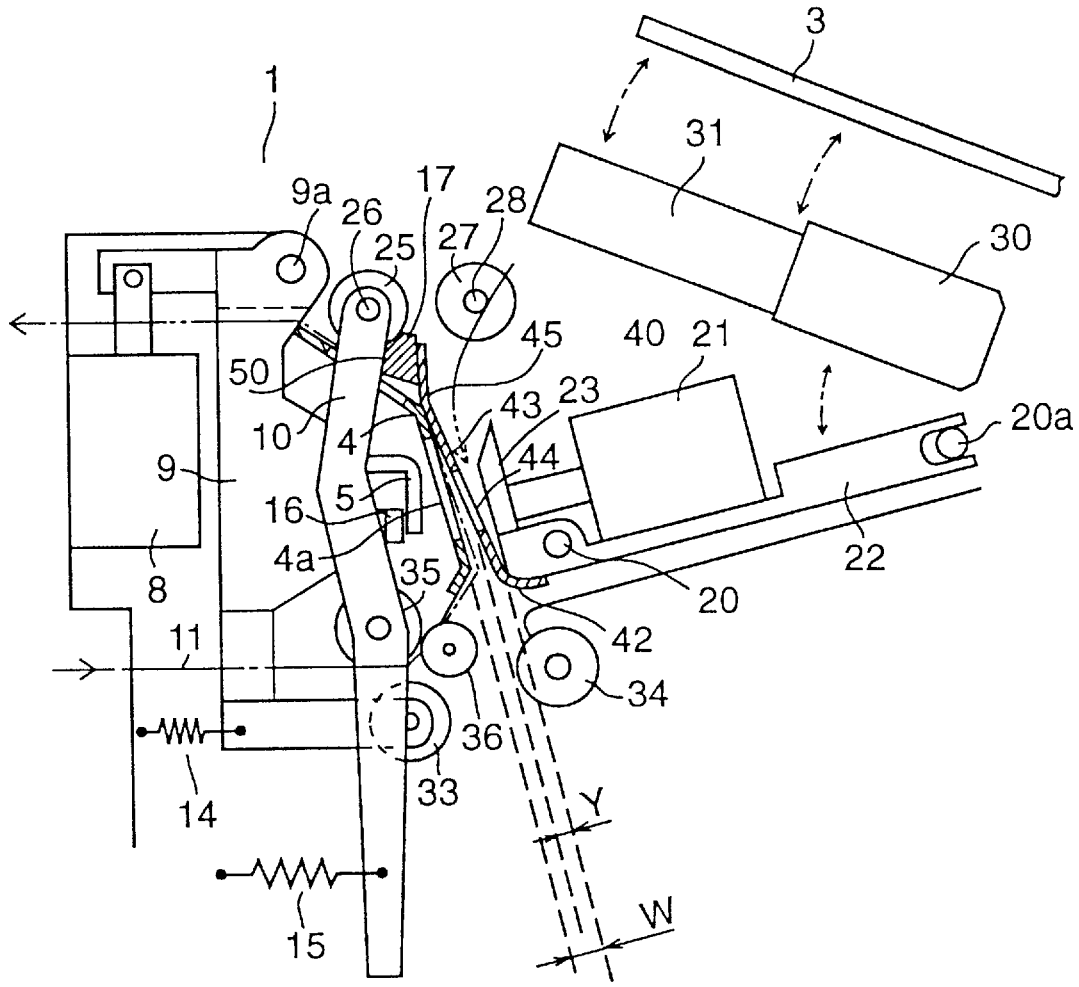
FIG. 5 is an enlarged cross section of the assemblies around the print head of the printer shown in FIG. 1 set to the standby mode for ink ribbon replacement.

FIG. 5 shows printer 1 in the standby mode with print head 23 set to the middle position shown in FIG. 4. Printer 1 is set to the standby mode by means of plunger 8, and a relatively wide effective platen gap W can therefore be held between print head 23 and paper guide 4 as shown in FIG. 3. When print head 23 is in the middle position as shown, contacting member 45 of mask plate 40 enters into recessed part 53 of mask guide 50. Because mask plate 40 is flexible, mask plate pressing member 43 rotates to a position contacting paper guide 4, and the inclination angle of mask plate 40 changes. As a result, a relatively wide gap Y can be assured between mask plate 40 and print head 23.

In addition, recessed part 53 of mask guide 50 of this embodiment is sufficiently thick to completely cover contacting member 45 of mask plate 40. As a result, when mask plate contacting member 45 enters recessed part 53, contacting member 45 does not project above mask guide 50, and ink ribbon 31 therefore does not catch on contacting member 45 when the ink ribbon cartridge is loaded into the printer.

If print head 23 is thus positioned and cover 3 covering printer 1 is opened, the area between print head 23 and mask plate 40 will be open wide, and ink ribbon 31 can be easily placed in printer 1 from above. More specifically, if ribbon case 30 is removed from the body, ink ribbon 31 can be easily removed from between print head 23 and mask plate 40. If ribbon case 30 is loaded in the body, ink ribbon 31 can be easily and smoothly loaded because the area between print head 23 and mask plate 40 will be open wide. In this case, because mask plate 40 is sloped toward paper guide 4 and the top is open, mask plate 40 functions as a guide directing ink ribbon 31 to the predetermined position when ink ribbon 31 is inserted from above. As a result, ink ribbon 31 will not be wrinkled or creased when it is loaded, and can be prevented from entering between mask plate 40 and paper guide 4, and the causes of various printing problems can be prevented. Furthermore, because the user can replace the ribbon without particular care being required, the time required to replace a ribbon can be greatly reduced.

Furthermore, if contacting member 45 of mask plate 40 is set to recessed part 53 in the middle of mask guide 50, the gap between mask plate 40 and paper guide 4 is reduced, and pressing member 43 of mask plate 40 will essentially contact paper guide 4. Therefore, roll paper 11 can be pressed against paper guide 4 by mask plate 40 when roll paper 11 is fed using transport rollers 35 and 36, and the paper can be transported smoothly along paper guide 4. As a result, paper transport during journal printing is preferably accomplished with print head 23 set to approximately the middle. Incidentally, mask guide 50 in this embodiment additionally acts as a paper holder for roll paper in that roll paper is discharged through a slot defined between the mask guide 50 and the paper guide 4 as shown in FIG. 1.

Figure 6:
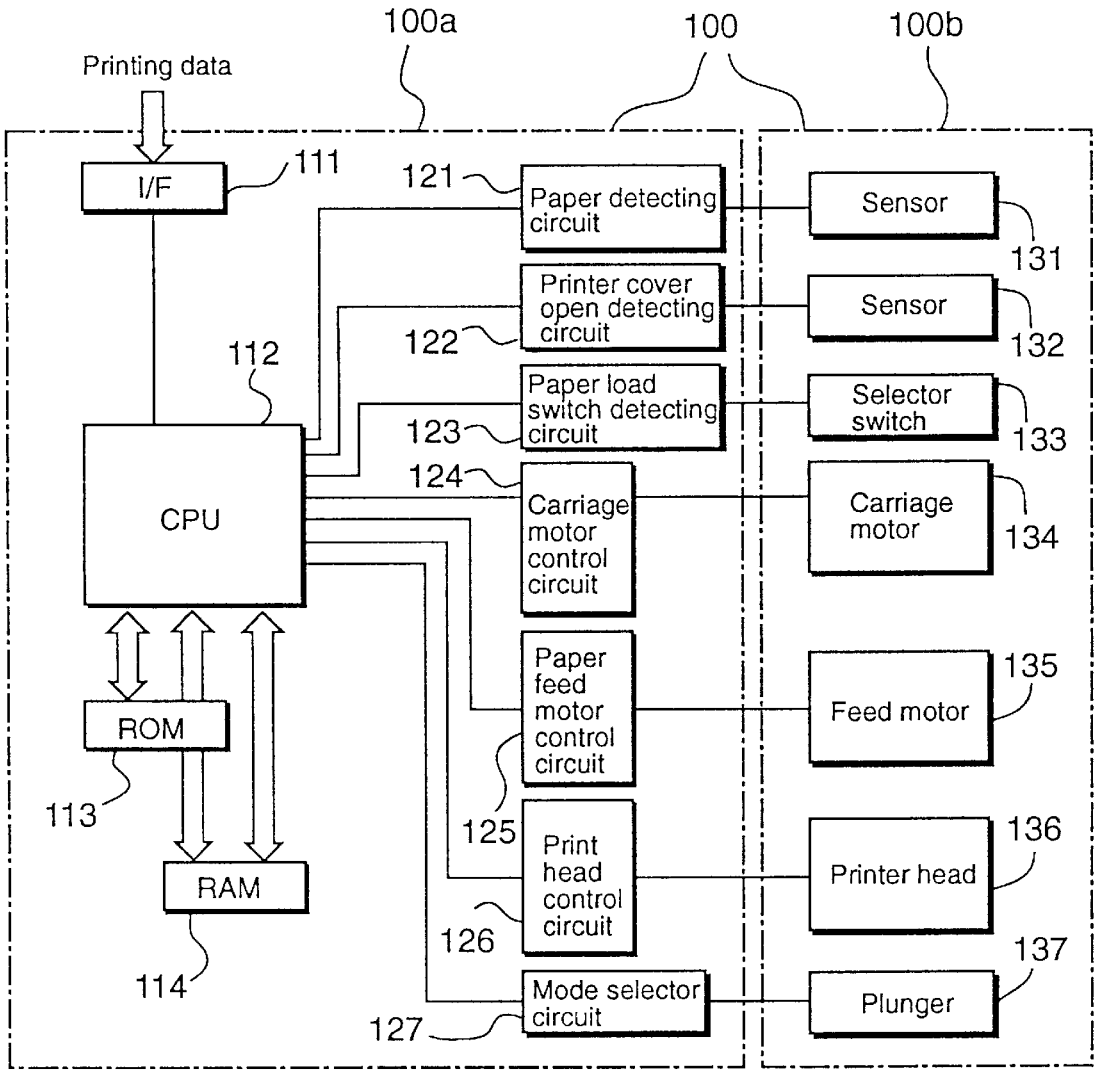
FIG. 6 is a block diagram of the control system of the printer shown in FIG. 1.

FIG. 6 is a block diagram of the control system of printer 1 according to the preferred embodiment. The control system consisting of control board 1*a* and printing mechanism 1*b* comprises an interface 111 for receiving print data from an external device, such as a personal computer or point-of-sale terminal, and a CPU 112 for controlling the printer according to the print data input through interface 111.

CPU 112 is connected to read-only memory (ROM) 113 for storing the control program and other static data as described below, and random access memory (RAM) 114 for temporarily storing the print data. These print data are output by CPU 112 to print head control circuit 126 for printing by print head 23.

Carriage motor 134 for driving carriage 22, carriage motor control circuit 124, feed motor 135 for transporting the paper and paper feed motor control circuit 125 are provided to enable printing to a predetermined position on the paper. Note that control circuits 124 and 125 are connected to CPU 112.

Paper sensor 131 for detecting paper insertion is connected to paper detecting circuit 121 of which signal is transmitted to CPU 112. By using paper sensor 131, it is possible not only to detect the insertion of paper but also to detect a bottom edge of the paper.

Sensor 132 for detecting opening and closing of printer cover 3, and printer cover open detector circuit 122 for inputting the status of sensor 132 to CPU 112, are provided to enable printer 1 to execute the operations described above for setting the paper and replacing the ribbon.

Selector switch 133 for selecting the paper type, and paper load switch detecting circuit 123 for detecting and outputting to CPU 112 the selected position of selector switch 133, are provided because printer 1 of this embodiment can print to three different types of paper.

A mode selector circuit 127 for switching the operating mode of printer 1 between a standby mode and a printing mode is also connected to CPU 112, and can be used to drive plungers 8, 19.

Figure 7:
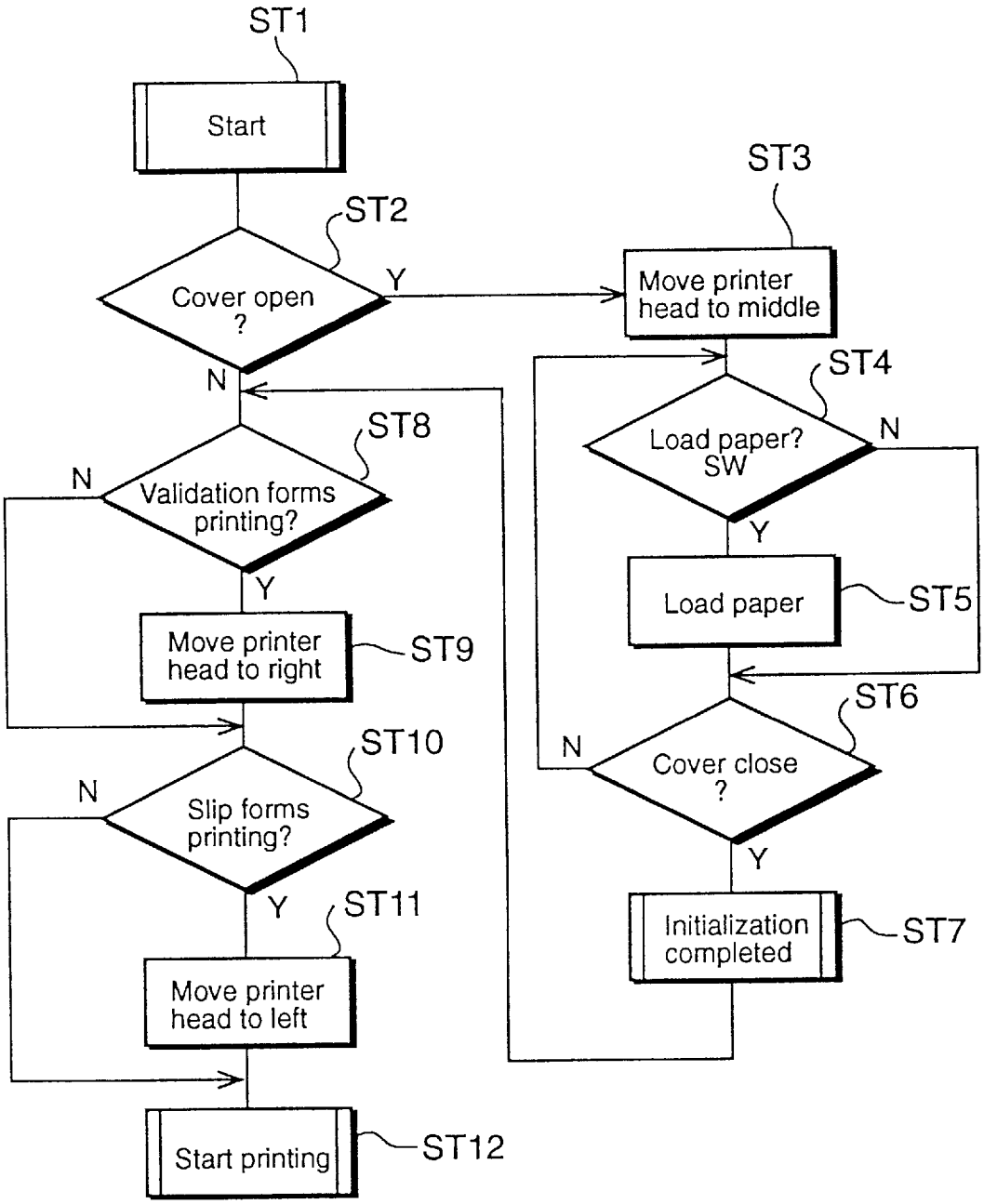
FIG. 7 is a flow chart of the control method for initializing the printer and loading the paper based on the control system shown in FIG. 6.

FIG. 7 is a flow chart of the control method for setting the paper and replacing the ink ribbon using the above control system, and is described below.

This control method starts when printer 1 is started at step ST1. The default mode of printer 1 is the standby mode because the printing mode is initiated by driving plunger 8. In addition, printer 1 of the preferred embodiment can thus be set to the standby mode by simply resetting the printer.

At step ST2, it is determined by means of sensor 132 whether the cover is open or closed. If cover 3 is open, carriage motor 134 is controlled in step ST3 to position print head 23 to the center position. If print head 23 is set to the center position in the standby mode, printer 1 will be in a condition as described with respect to FIG. 5 above. It will therefore be possible to easily change ink ribbon 31.

In step ST4, it is determined whether loading roll paper 11 is required based on the position of selector switch 133. If loading roll paper 11 is requested, the paper transport mechanism for roll paper 11 is operated using feed motor 135 in step ST5. When roll paper 11 is fed as described above, it is preferable to set print head 23 to the center position and to narrow the gap between mask plate 40 and paper guide 4.

Next, in step ST6, it is again determined whether cover 3 is open using sensor 132. If cover 3 is open, the procedure loops back to step ST4. If cover 3 is closed, printer initialization is determined in step ST7, and the procedure returns to the normal service loop.

When printer initialization is confirmed in step ST7, or when cover 3 is determined to be closed in step ST2 when the printer is started, the procedure advances to step ST8.

In step ST8, it is determined whether card printing is selected based on the position of selector switch 133. If card printing is selected, print head 23 is moved to the right side of printer 1 in step ST9. When print head 23 is positioned below the right-side transport roller 25*b*, printer 1 will be in the position shown in FIG. 3, and a card 12 can be smoothly and easily loaded trouble-free.

If in step ST8 card printing is not selected, the procedure jumps to step ST10. If slip printing is detected in step ST10, print head 23 is moved to the left side of printer 1 in step ST11. When print head 23 is positioned below the left-side transport roller 25*a*, a slip 13 can be smoothly and easily loaded as described with reference to FIG. 3.

Once paper loading is completed by the steps described above, the actual printing process can begin in step ST12. In step ST12, mode selector circuit 127 selects the printing mode, and drives plunger 8. The paper transport mechanisms and the platen are thus moved to the predetermined positions required for printing, and printing is executed using the print head.

Figure 8:
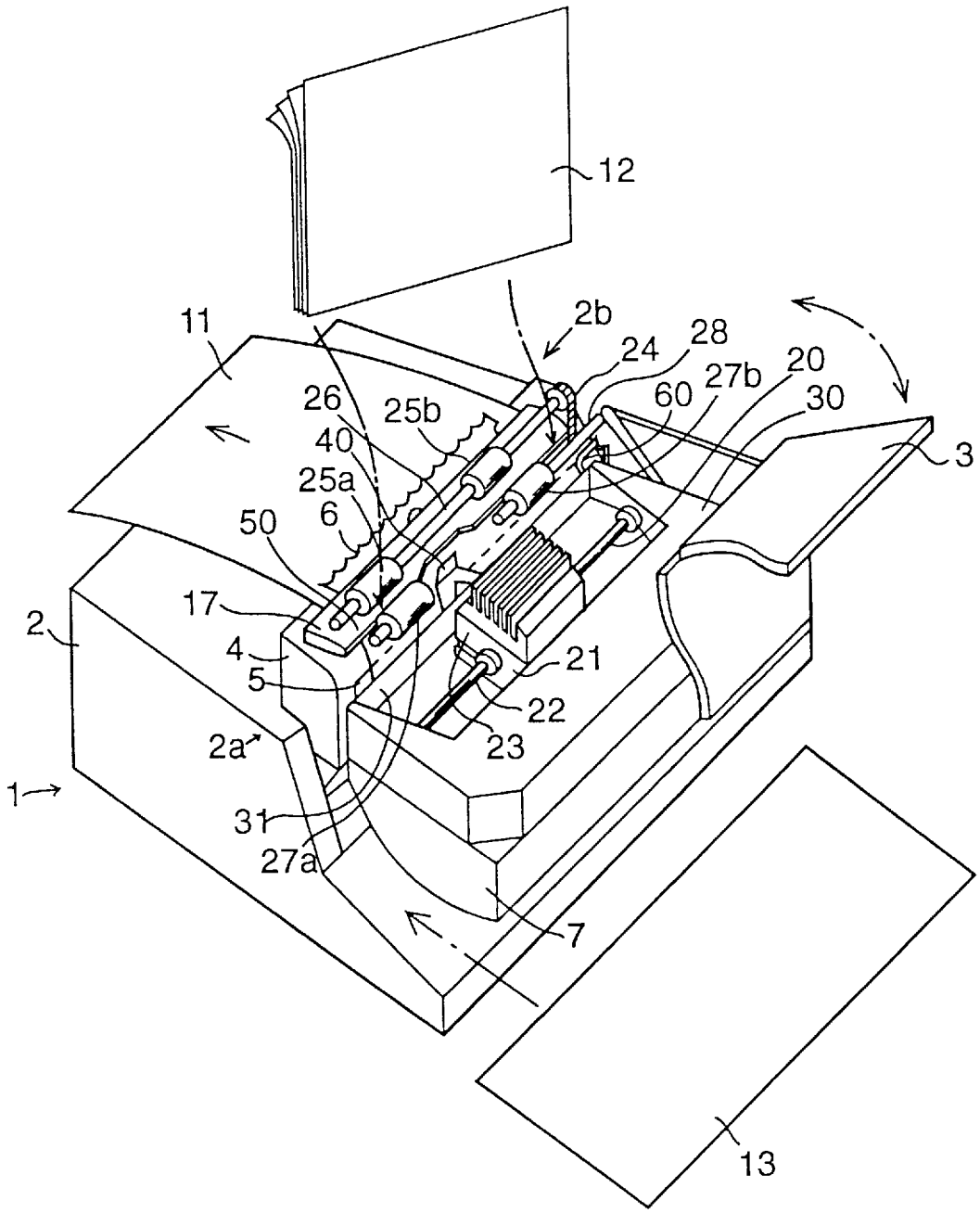
FIG. 8 is a bird's-eye view of a printer according to a second embodiment of the present invention.

FIG. 8 is a bird's-eye view of a printer 1 according to a second embodiment of the present invention. Printer 1 of this embodiment differs from the first embodiment only with regard to the mechanism used to control the position of mask plate 40'. Although not shown in the drawings, the first and second embodiments may also be combined in one printer.

Instead of mask guide 50 a paper holder 50' is disposed above paper guide 4 to guide the roll paper as it is advanced after printing, i.e. roll paper is guided through a slot defined between paper holder 50' and the paper guide 4. Paper holder 50' is not used as a mask guide in this embodiment, i.e. the entire edge of paper holder 50' facing print head 23 is retracted enough not to be engaged by mask plate 40'. In the second embodiment control of the mask plate's positions is achieved by means of a mask guide 60 which is disposed at the edge of the range of print head 23 movement, i.e., on the right side edge as seen from print head 23.

Figure 9A:
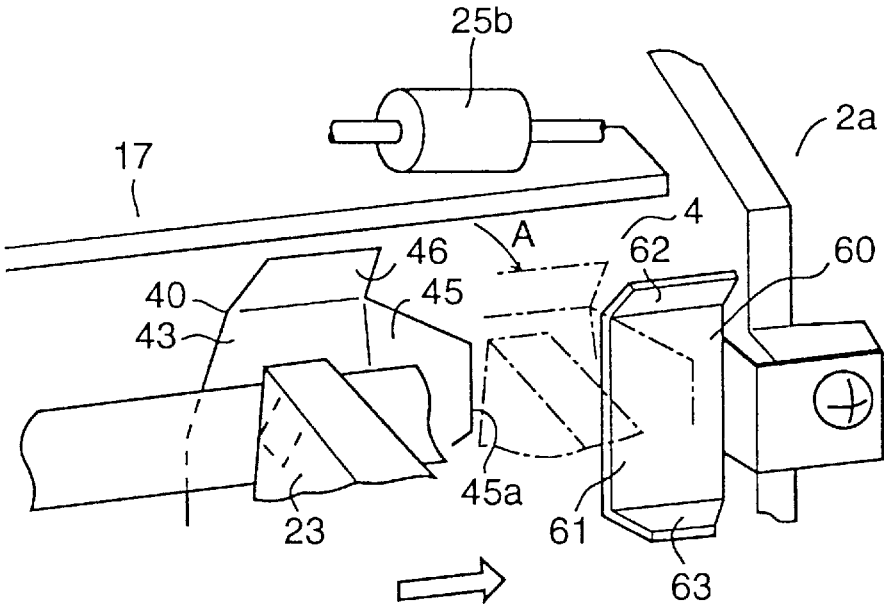
FIGS. 9(A) and 9(B) are enlarged views of the mask guide of the printer shown in FIG. 8.
Figure 9B:
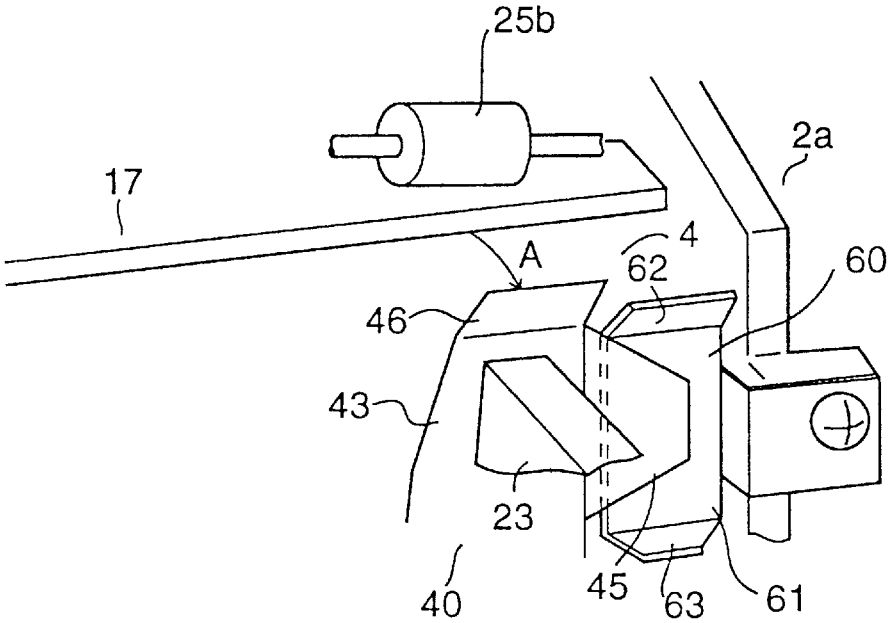

The area around mask guide 60 is shown enlarged in FIGS. 9(A) and 9(B). Mask guide 60 of the present embodiment comprises a plate fastened to the right side 2*a* of the printer body. Mask guide 60 of this embodiment comprises a substantially flat guide plate 61 on the print head 23 side of mask plate 40' relative to the platen or paper guide 4. Guide plate 61 projects from right side 2*a* of the printer body only enough to contact mask plate 40', which is described below, when print head 23 moves to the right side. Therefore, unless print head 23 moves to this right side, guide plate 61 and mask plate 40' do not touch, and mask plate 40' functions to press the paper against the platen (or abuts against the paper guide in the standby mode). If mask guide 60 is disposed at the side of the body, it is convenient to use the printer body for support, and mask guide 60 will not be an obstruction to ink ribbon replacement. It is to be noted that top 62 and bottom 63 of guide plate 61 are inclined toward print head 23 such that when the edge of the paper contacts guide plate 61, the paper is guided to paper guide 4.

Mask plate 40' of this embodiment differs from that (40) of the first embodiment only in that member 45 has no longer the function of being engaged for position control and in that a contacting member 46 is additionally provided. Contacting member 46 extends horizontally to, rather than vertically above, pressing member 43 because mask guide 60 is disposed in the direction of print head 23 movement, i.e., at the right side as described above. In this embodiment, contacting member 46 is provided on the right side as seen from print head 23. Like in the first embodiment, member 45 on top of pressing member 43 of mask plate 40' is sloped towards print head 23 such that when the edge of the paper meets member 45, the paper is guided between mask plate 40' and paper guide 4 or the platen.

Contacting member 46 of this embodiment extends sloping gently from pressing member 43 toward print head 23 such that the leading edge 46*a* of contacting member 46 contacts guide plate 61 when the print head 23 is moved towards the right end of its range of movement in the standby mode, i.e. when the platen is retracted inside paper guide 4 and mask plate 40' contacts paper guide 4. As a result, when print head 23 moves toward the right side, leading edge 46*a* of contacting member 46 engages guide plate 61 when print head 23 is near the right side. Moreover, when print head 23 moves further to the right side, contacting member 46 moves in contact with the edge of guide plate 61, and pressing member 43 of mask plate 40' is rotated toward print head 23 as shown by arrow A, guided by the slope of contacting member 46.

It is also possible to provide a guide plate inside the edges of the range of print head movement (unlike the edge area placement of the mask guide described above), and force the mask plate toward the platen by projecting the guide plate toward the platen. In such case the mask plate would be urged toward the print head, i.e., in the direction opposite that described in this embodiment, near the edges of the movable range as a means of opening the gap between the mask plate and the platen or paper guide. However, considering the precision required for this type of guide plate and the need for simple ink ribbon replacement, it is preferable to provide the mask guide on one side. Furthermore, because the feed rollers for transporting the paper are usually placed near the sides, if the mask plate is at the side when the paper is loaded, the mask plate and feed rollers can be easily combined to form a path for paper insertion.

Figure 10:
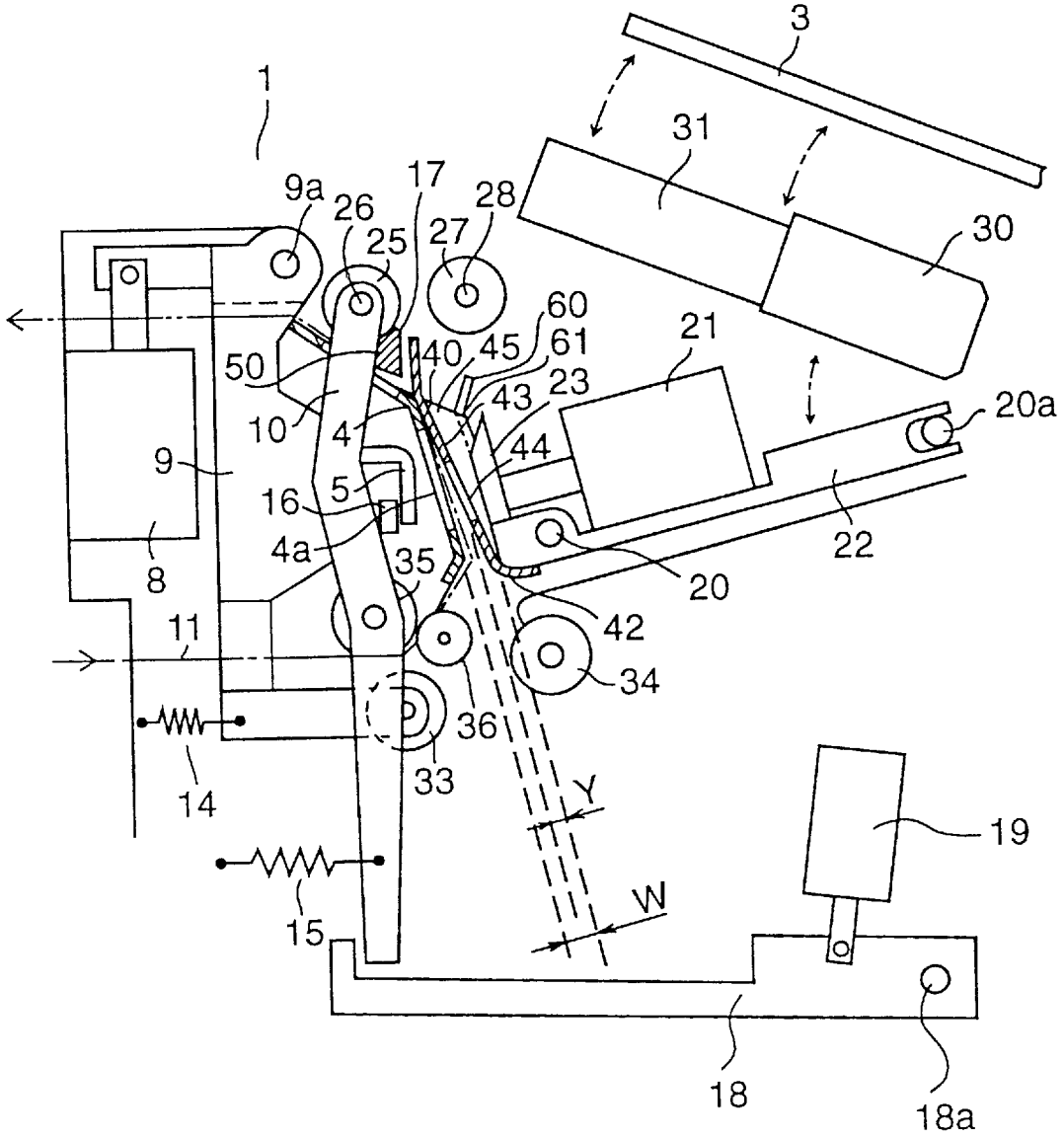
FIG. 10 is an enlarged cross section of the assemblies around the print head of the printer shown in FIG. 8 set to the standby mode for ink ribbon replacement.

FIG. 10 is a cross section of a printing apparatus according to this second embodiment when print head 23 is positioned as shown in FIG. 9(A). FIG. 10 shows printer 1 set to the standby mode by means of plunger 8 with a wide effective platen gap W maintained between print head 23 and paper guide 4. Because print head 23 is positioned in the middle of the printing area, contacting member 46 of mask plate 40' does not contact guide plate 61. As a result, mask plate 40' is pressed to paper guide 4, and a wide gap Y is maintained between mask plate 40' and print head 23. This standby mode is therefore suited to ink ribbon replacement. If printer 1 is set to the printing mode by means of plunger 8, platen 5 projects from paper guide 4 as shown in FIG. 2, the paper is pressed against the platen by mask plate 40', and low noise, high quality printing can be accomplished.

Figure 11:
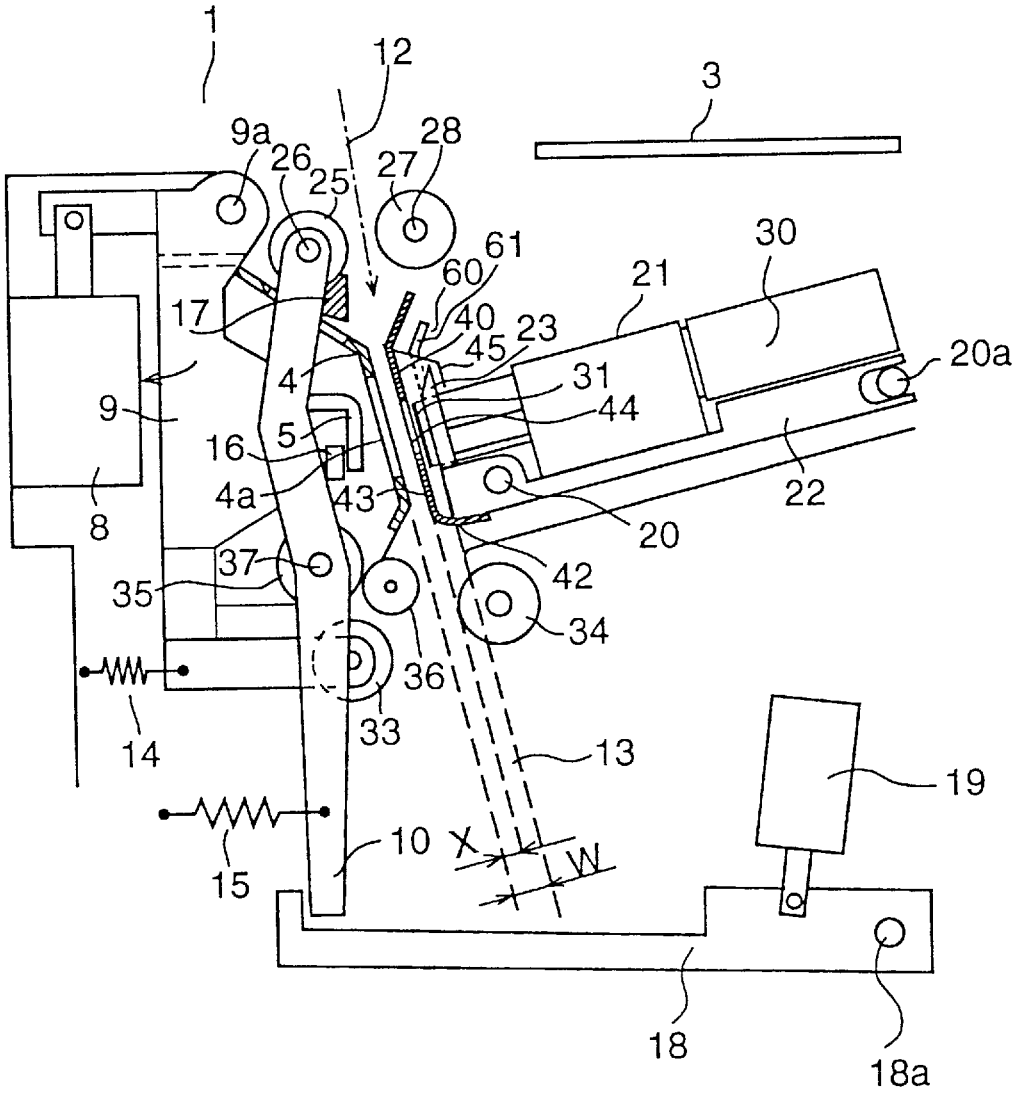
FIG. 11 is an enlarged cross section of the assemblies around the print head of the printer shown in FIG. 8 set to the standby mode for paper insertion.

FIG. 11 is a cross section of a printing apparatus according to this second embodiment when print head 23 is positioned as shown in FIG. 9(B). When print head 23 moves to the right side as described above, contacting member 46 of mask plate 40' contacts guide plate 61, and mask plate 40' is lifted away from platen 5 toward print head 23 by the action of contacting member 46 riding up on guide plate 61. As a result, the gap between print head 23 and mask plate 40' narrows, and the gaps between mask plate 40' and platen 5, and mask plate 40' and paper guide 4, widen, thus facilitating insertion of a card 12 from above into the printer. In addition, because mask plate 40' is operated from the side of print head 23 in a printer according to this embodiment, a gap with no obstructions between mask plate 40' and paper guide 4 can be assured. As a result, there is nothing for the leading edge of card 12 to stop against when card 12 is being inserted, and the user can therefore set card 12 into printer 1 without applying any force. As a result, card 12 can be loaded smoothly and dependably into printer 1 without the edges of card 12 catching on any obstruction or becoming curled or otherwise damaged. When print head 23 moves from the side toward the center of the printing area after loading card 12, contacting member 46 of mask plate 40' separates from guide plate 61. This frees mask plate 40' to return forward from print head 23 and hold card 12 against paper guide 4 or platen 5. By operating plunger 8 at approximately the same time, card 12 is held by transport rollers 25, 27, 33, and 34, and advanced to the position at which printing begins.

The control system of a printer 1 according to this second embodiment may be the same as that described above with reference to FIG. 6. The control method for loading the paper and replacing the ink ribbon may also be a control method comprising the steps described with reference to FIG. 7, except that the position of print head 23 when ink ribbon 31 is replaced in step ST3 is not limited to the center position as described in the first embodiment above and may be anywhere except for the right side as described in this embodiment. When printing is selected, it is also necessary in step ST9 to move print head 23 to the right side of printer 1 such that contacting member 46 of mask plate 40' contacts guide plate 61 and opens a gap for paper insertion.

As mentioned before, the first and second embodiments may be combined to a third embodiment. The third embodiment corresponds to the first one with elements 46 and 60 of the second embodiment added. The advantage of the third embodiment compared to the first one will be explained with reference to FIG. 3. By moving the print head so that contacting member (46) is engaged with mask guide (60), the mask plate 40 is retracted from engagement between contacting member 45 and guide member 51 and turned further toward the print head 23. Thus, a gap is opened between contacting member 45 and guide member 51 and insertion of a card is facilitated even more.

Note that while the mask plates 40, 40' have been described to be resilient like a leaf spring. A hinged-attached presser plate biased by a spring could be used instead.

As described hereinabove, a printer according to the present invention comprises a mask plate whereby printing can be accomplished with little noise, and is trouble-free and of high quality. By controlling the position of the mask plate in the standby mode using the mask guide, cards and other types of cut-sheet type paper can be loaded easily and trouble-free, and ink ribbon replacement is facilitated. Moreover, the position of the mask plate in a direction substantially perpendicular to the slip or other paper is corresponding to a position of the print head so that the position of the mask plate can be easily controlled by only moving the print head. As a result, it is possible to easily load ply paper without trouble, and to easily replace the ink ribbon, by means of a printing apparatus of simple construction as described above. As a result, the present invention is suited for application in printers frequently handling cut-sheet type paper such as cards and slips for which the paper loading and ejecting operations are frequently executed, and can prevent excessive paper costs due to paper loading problems as well as the increased time required for printing. The present invention is therefore suited for use in cash registers, point-of-sale terminals, and other terminal devices used in stores and other applications where cut-sheet type paper is frequently used, as well as multiple function data processing systems. By using a printing apparatus according to the present invention, excessive paper consumption can be prevented, the time required for printing and user maintenance tasks can be reduced, and customer service can be improved by reliably outputting unsmudged, clearly printed paper.

In addition, a printer according to the above embodiments operates the mask plate from the print head side and can, therefore, completely open the gap between the mask plate and platen or paper guide by narrowing the gap between the mask plate and print head. Therefore, cards can be loaded into the paper guide of the printer, i.e., between the mask plate and platen, without resistance. As a result, it is not necessary to apply any force to correct the position of the card even if it is not straight and must be repositioned. The user is, therefore, able to load and position a card in the printer by simply dropping the card into the paper guide aligned to the right side thereof.

In addition to the simplicity of paper loading described above, the ink ribbon can also be easily replaced. Printer maintenance is therefore simplified and a user-friendly printer can be provided.

In the above embodiments, a plate-like mask guide is used with part of the mask plate set against part of the mask guide to control the position of the mask plate, but it will be obvious that a cam mechanism rotating in conjunction with the movement of the carriage could also be used to control the mask plate position. Furthermore, while in the above embodiments the mask plate is fixed to the carriage 22 and the mask guide is fixed relative to the printer body, this could be exchanged, in particular in a printer not allowing paper insertion from below the head unit.

Furthermore, at least in the first embodiment, the position of the rollers used in the paper transport mechanism is substantially aligned with the position at which the mask plate-to-print head gap is reduced, but it will also be obvious that paper can be easily loaded by narrowing the mask plate-to-print head gap without aligning said positions. Furthermore, the path for loading the paper can be formed by means of a plate or similar means near the paper transport mechanism rather than forming the paper path with said rollers.

In the first and third embodiments, when the position of the rollers changes, it is also simple to change the mask guide in order to control the mask plate according to the changed roller position. Furthermore, when the mask guide is changed, it is possible to change the position controlling the mask plate by simply moving the print head according to the new mask guide position.

Printers in which the present invention is applied shall not be limited to stand-alone units as described hereinabove, but may be used as part of a cash register or point-of-sale terminal assembly. Furthermore, the above embodiments detect whether the printer cover is open to generate a signal for moving the print head to the center ink ribbon replacement position, but it will be obvious that a reset signal or other signal may also be used.

A selector switch is also provided to detect the type of paper and printing mode, e.g., card printing, but it is also possible to provide a sensor in the paper insertion area of the paper transport mechanism to automatically detect the paper type and move the print head accordingly.

What is claimed is:

1. A method of controlling a printing apparatus having a platen displaceable between a standby position and a printing position and a guide member arranged in a fixed relation to and in a lengthwise direction of the platen, wherein said guide member has a first portion and a second portion; said method comprising the steps:

a. setting the platen to the standby position;

b. moving a print head into a position at which a mask plate assumes a first position;

c. detecting an insertion of a cut sheet type recording medium;

d. conveying the recording medium into the paper passage until at least a top edge has passed a printing position;

e. displacing the mask plate in a direction substantially perpendicular to the paper passage between a first position when the print head is positioned opposite the first portion of the guide member and a second position when the print head is positioned opposite the second portion of the guide member; and f. performing serial printing on the recording medium.

2. A method of controlling the printing apparatus, said method comprising the steps of:

a. setting a platen to a standby position;

b. moving a print head into a position at which a mask plate assumes a first position;

c. detecting an insertion of a cut sheet type recording medium;

d. conveying the recording medium into the paper passage until at least a top edge has passed a printing position;

e. moving the platen into a printing position whereby the mask plate presses the recording medium against the platen;

f. performing serial printing on the recording medium; and g. moving, in response to a cover sensor indicating the opened position of a cover means, the print head into a position at which the mask plate assumes a second position.

3. A control method for printing on a cut-sheet type recording sheet by a printing apparatus having a mask plate disposed on a carriage between a print head and a platen, a guide plate having a recessed portion and a contacting portion, and reciprocated together with the carriage; the control method comprising the steps of:

a. placing the platen in a first position at a first distance from the print head so that a gap between the print head and the platen is widened;

b. detecting an insertion of a recording sheet;

c. conveying the cut sheet type paper until at least a top of the recording sheet passes through a printing position when detected in said detecting step;

d. placing the platen in a second position at a second distance from the print head so that the platen is brought into contact with the mask plate and the gap between the mask plate and the guide plate is widened to smoothly convey the recording sheet, wherein the first distance is greater than the second distance.

4. A control method for printing on a recording sheet by a printing apparatus having a mask plate disposed on a carriage between a print head and a platen, in contact with a guide plate having a recessed portion and a contacting portion, the method comprising the steps of:

a. detecting when a cover of a housing accommodating the printing is in an open position; and b. transporting the carriage to a position wherein the print head is positioned opposite to recessed portion of the guide plate so that a gap between the print head and the mask is widened.

* * * * *

UNITED STATES PATENT AND TRADEMARK OFFICE

CERTIFICATE OF CORRECTION

| | | |
|---|---|---|
| PATENT NO. | : | 5,863,139 |
| DATED | : | January 26, 1999 |
| INVENTOR(S) | : | Naoki Asai, et al. |

It is certified that errors appear in the above identified patent and that said Letters Patent is hereby corrected as shown below:

Title page, item 76, Inventors: delete "3-5 Owa 3-chome," and "Naguno-ken 392, c/o Seiko Epson Corporation,".

Title page, insert item 73, --Assignee: Seiko Epson Corporation, Tokyo, Japan--.

Signed and Sealed this

Eighth Day of February, 2000

*Attest:*

Q. TODD DICKINSON

*Attesting Officer*

*Commissioner of Patents and Trademarks*